United States Patent [19]

Horlander

[11] Patent Number: 4,531,134

[45] Date of Patent: Jul. 23, 1985

[54] REGULATED VOLTAGE AND APPROXIMATE CONSTANT POWER FOR THERMAL PRINTHEAD

[75] Inventor: Frank J. Horlander, Lexington, Ky.

[73] Assignee: International Business Machines Corporation, Armonk, N.Y.

[21] Appl. No.: 593,052

[22] Filed: Mar. 26, 1984

[51] Int. Cl.[3] ..... B41J 3/20

[52] U.S. Cl. ..... 346/76 PH; 219/216

[58] Field of Search ..... 346/76 PH, 76 R, 153.1, 346/154; 219/216 PH, 216 R; 400/120-125; 358/300; 250/317.1, 318; 364/519; 101/DIG. 2, 93.03, 93.04, 93.05

[56] References Cited

U.S. PATENT DOCUMENTS

| | | | |
|---|---|---|---|
| 4,168,421 | 9/1979 | Ito | 346/76 PH |
| 4,330,786 | 5/1982 | Hatabe et al. | 219/216 PH |
| 4,345,845 | 8/1982 | Bohnhoff et al. | 101/DIG. 2 |
| 4,384,797 | 5/1983 | Anderson et al. | 400/120 |
| 4,420,758 | 12/1983 | Tabata et al. | 346/76 PH |
| 4,434,356 | 2/1984 | Craig et el. | 219/216 |

*Primary Examiner*—E. A. Goldberg
*Assistant Examiner*—A. Evans
*Attorney, Agent, or Firm*—John A. Brady

[57] ABSTRACT

Electrodes 1*a* through 1*n* are driven by operational amplifier 4 under control of a reference current source 25. The voltage at each electrode 1*a* through 1*n* is monitored by diodes 19*a* through 19*n* so that point 21 is set at that of the lowest electrode voltage. A current source provides equal currents through diode 23 and the conducting one of diodes 19*a* through 19*n*. The potential of control input 5 is therefore that of the lowest potential of all of electrodes 19*a* through 19*n*. Feedback through resistor 27 produces a differential amplifier system in which V2 is set by source 25. The output of amplifier 4 and the magnitude of resistors 15*a* through 15*n* are selected so that the nominal voltage on line 13 is reduced by one-half across the resistor 15*a* through 15*n*. This approximates constant power to ribbon 2. The voltage regulation and constant power each act to limit power dissipation at the ribbon surface. This reduces debris at the printhead.

28 Claims, 2 Drawing Figures

REGULATED VOLTAGE AND APPROXIMATE CONSTANT POWER FOR THERMAL PRINTHEAD

BACKGROUND OF THE INVENTION

1. Technical Field

This invention relates to driver circuits for thermal printheads employing a ribbon that generates localized heat in the ribbon in response to electrical current. The localized heat then serves to cause ink transfer to a receiving medium. Typically, the electrical signals are applied by printhead electrodes wiping across an outer layer of the ribbon which is characterized by moderate resistivity. These signals move inwardly to a layer that is highly conductive (typically an aluminum layer) with localized heating occurring in the process. The electrical circuit is completed by an electrode connected to ground which intersects the ribbon. This invention is directed to providing practical, effective, and cost-efficient circuitry to control current to the ribbon from the printhead in a manner which adjusts to electrical-circuit conditions while limiting power at the ribbon surface.

2. Background Art

The printing system to which this invention is directed and current control systems for the printhead are disclosed in U.S. Pat. No. 4,345,845 to A. E. Bohnhoff et al and U.S. Pat. No. 4,434,356 to T. P. Craig et al. The foregoing U.S. Pat. No. 4,434,356 teaches regulated constant-current circuits having each of the electrodes. The foregoing U.S. Pat. No. 4,345,845 describes a voltage source regulated in response to a voltage sensed at the ribbon at a location spaced from the printing zone. This invention also employs a regulated voltage source. The voltage is regulated in response to the level sensed at each electrode through diodes connected to each electrode. The foregoing U.S. Pat. No. 4,434,356 employs diodes connected to each electrode, but the signal is not used in a voltage-source system.

This invention also employs a voltage-divider circuit to each electrode having a resistor between the regulated voltage output and the electrode which is selected to provide at nominal conditions the same voltage drop as that across the ribbon. No directly similar design is known, but the general relationship has been understood in connection with operating bipolar transistors. The foregoing U.S. Pat. No. 4,345,845 and U.S. Pat. No. 4,420,758 to Tabata et al discloses such resistors to limit current flow. The second patent is to a range of 1/10 to 10 times the full resistance in the ribbon, while this invention is to an approximately specific value.

DISCLOSURE OF THE INVENTION

This invention is a circuit to drive plural electrodes (typically forty) of a resistive ribbon printer. The volage at each electrode is monitored, and the lowest voltage predominates as one control input to a differential amplifier. Monitoring is from a common node or point through diodes or other unidirectional devices, one connected in parallel with each electrode to pass high signals on the common point.

The output of the differential amplifier drives all the electrodes, each in series with a substantially identical, separate resistor. The second input to the differential amplifier is at a set, reference-level difference from the output. The potential across the series resistor to the electrode with the lowest voltage is kept constant. The electrode with the lowest voltage thereby receives a fixed current, and the other electrodes are subject to limited power excursions.

In the preferred embodiment a similar, oppositely poled diode is connected between the common point of the monitoring diodes and the control input of the amplifier. The embodiment includes a constant-current source applied to all the diodes to maintain them in consistent operating ranges. The source need not be precise.

Each of the separate resistors forms a voltage-divider circuit with the elements driven by the electrode it drives. At the representative or nominal conditions, it will be shown in accordance with this invention that the same power into the driven elements is approximated when the amplifier output is approximately twice the voltage across the driven elements and the voltage drop across the separate resistor is the same as the voltage drop across the driven elements at the nominal conditions. The level of amplifier output and the magnitude of the separate resistors are selected to provide this.

Avoiding power excusions at the ribbon prevents debris formation on the printhead and physical damage of the printhead. This is primarily because arcing at imperfect contacts with the ribbon is avoided. Overall reliable operation with fast, positive start of printing is realized.

Approximating constant power into the ribbon provides consistent printing, which can be particularly important in that it provides a wider range for satisfactory erasure conditions by thermal bond. Such erasure is described in U.S. Pat. No. 4,384,797 to Anderson et al. The approximately constant delivery of power is necessarily achieved by currents and voltages which are not subject to drastic change, and this relative constancy also minimizes arcing. Minimizing arcing reduces ribbon damage and consequent debris.

Finally, this can be implemented by circuitry in which small voltage drop occurs across the switches to the electrode. This permits the switches to be miniaturized and tightly packed on a standard circuit chip.

BRIEF DESCRIPTION OF DRAWING

The details of this invention will be described in connection with the accompanying drawing, in which.

BEST MODE FOR CARRYING OUT THE INVENTION

Figure 1:
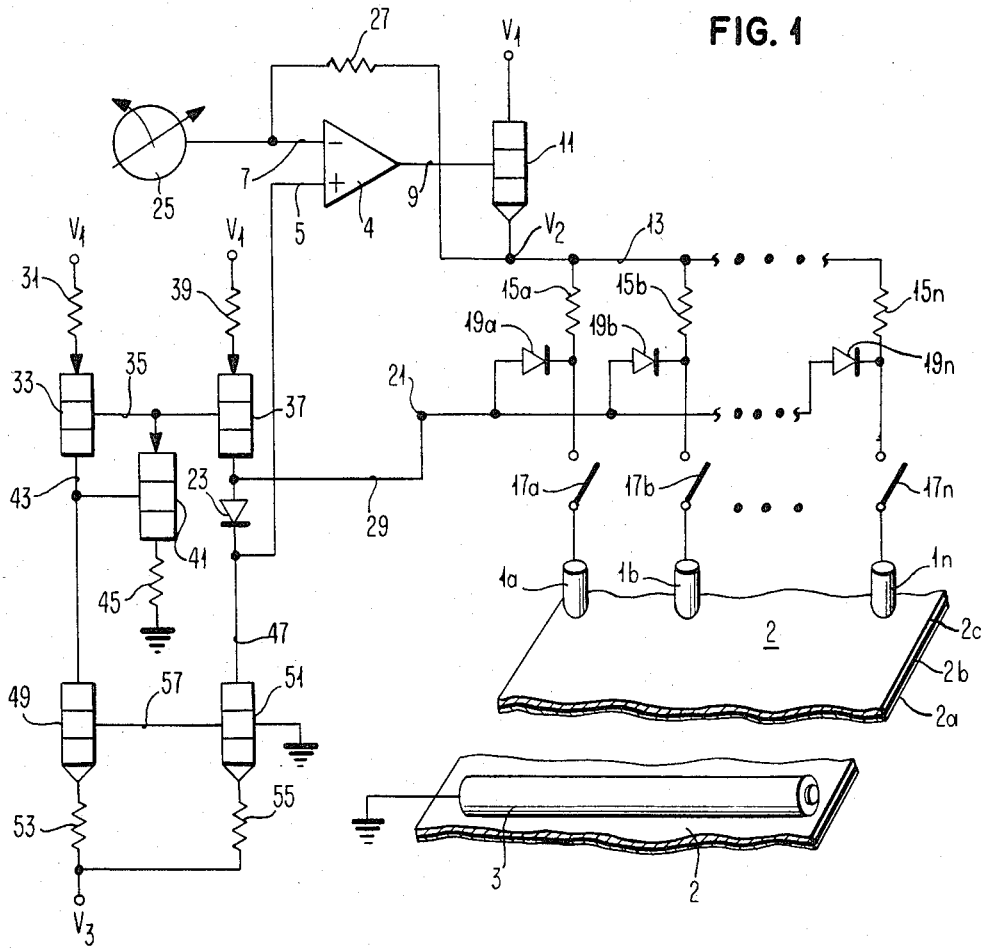
FIG. 1 is a conventional schematic illustration of circuitry for printing by electrodes and FIG. 2 is an operating diagram illustrating the approximate constant power voltage-divider operation.

Referring to the drawings, electrodes 1*a*, 1*b* through 1*n*, (a typical number of which is 40), have current driven through them to ground for printing. Specifically, in a ressitive ribbon embodiment of direct interest for this best mode, electrodes 1*a* through 1*n* are close together in a vertical column and in contact with a resistive ribbon 2, as is known and described, for example, in the patents discussed above under the heading "Background Art." Each electrode 1*a* through 1*n* is solid metal having negligible resistance in this context of resistive ribbon printing. A ground connection, which may be a roller 3, typically is firmly pressed against the ribbon 2 on the same side contracted by electrodes 1*a* through 1*n*.

Ribbon 2 from the side is shown illustratively in exaggerated form in FIG. 1. Ribbon 2 is a lamination of constant cross-section. Layer 2*a*, farthest from the electrodes, is the meltable ink. A thin internal layer 2*b* is a highly conductive layer, typically aluminum, which facilitates low-power conduction from areas directly across from electrodes 1*a* through 1*n* to ground roller 3. An aluminum layer 2*b* also inherently provides a thin, outer aluminum oxide surface which is relatively highly resistive. The resistive substrate 2*c*, typically a carbon black filled polycarbonate resin, is contacted by electrodes 1*a* through 1*n*.

Electrodes 1*a* through 1*n* are driven by operational amplifier 4, which functions as a differential amplifier as will be described. Amplifier 4 has a control input 5, which is the positive or plus input and a reference input 7, which is the negative or minus input.

The plus and minus input designations are conventional, indicating that a rising signal on control input 5 is responded to by amplification providing a rising signal at the output 9 of amplifier 4. Conversely, a rising signal on reference input 7 is responded to by amplification providing a falling signal at output 9.

Amplifier 4, as a standard operational amplifier, provides reliable output with negligible input current on inputs 5 and 7. This facilitates overall circuit design and permits designs having a wide range of operability. It will be apparent, however, that amplifier systems having other characteristics can function for operational amplifier 4 so long as additional current flow and the like is compensated for or otherwise taken into account in each circuit design. Output 9 drives the base of bipolar transistor 11. The emitter of transistor 11 is connected to line 13, and the collector of transistor 11 is connected to operating voltage V1, typically +38 volts. Transistor 11 thus serves to provide current isolation between output 9 and line 13, with a small voltage potential drop inserted by the inherent forward biased base-to-emitter drop of transistor 11. It will be recognized that transistor 11 is a simplified implementation of a power amplifier, for example, a Darlington pair of transistors.

Line 13 is connected to all of the electrodes 1*a* through 1*n* by identical, individual resistors 15*a*, 15*b* through 15*n*, each connected in series circuit between line 13 and one electrode 1*a*, 1*b* through 1*n*, respectively. Also in series circuit between electrodes 1*a*, 1*b* through 1*n* is a switch 17*a*, 17*b* through 17*n*, respectively. (Switches 17*a* through 17*n* are illustrated entirely symbolically as such switches for the purpose of selecting electrodes may be standard. In an actual embodiment, they each include individual transistors or, more preferably, a Darlington configuration of transistors switched off-and-on by a signal to the base or the equivalent control input to thereby open and close the path through switches 17*a* through 17*n*. The voltage drop across a switched-on transistor switch 17*a* through 17*n* is negligible because the circuit is designed to operate the pertinent transistors in switches 17*a* through 17*n* in saturation.)

The junction of each electrode 1*a* through 1*n* and its associated resistor 15*a* through 15*n*, respectively, has one diode, 19*a*, 19*b* through 19*n*, respectively, connected to it. Diodes 19*a* through 19*n* are connected in a polarity to be non-conductive to or block signals provided by amplifier 9. The side of each diode 19*a* through 19*n* opposite the connection to the electrodes 1*a* through 1*n* connect to a common point 21. Diode 23, oppositely poled to diodes 19*a* through 19*n*, is connected in series between point 21 and control input 5, and as part of a current source as discussed below. Diode 23 and diodes 19*a* through 19*n* are selected to be virtually identical. They are mounted close together and in the same general environment and therefore have the same characteristics. As is discussed below, diode 23 and only one of diodes 19*a* through 19*n* will be conducting during the great majority of printing operations. They will carry the same current and the voltage drop across the diode 23 and across the conducting one of diodes 19*a* through 19*n* will cancel, thereby providing on control input 5 close to the exact potential of the lowest potential on electrodes 1*a* through 1*n*.

V2 is the potential on line 13. Source 25 is an adjustable, constant-current source connected to reference input 7, which provides a current the same in polarity and direction as that provided by V2. Source 25 is illustrated entirely symbolically as such an adjustable current source is known as a control for electrode printing and forms no part of this invention. Resistor 27 is connected across input 7 to line 13.

The system connected by line 29 to point 21 forms a source of constant current. The overall design approach to achieve constant current is considered conventional. Operating voltage V1 is connected through resistor 31 to the emitter of bipolar transistor 33. The base of transistor 33 is connected on line 35 to the base of transistor 37. Transistors 33 and 37 are selected to be virtually identical. They are mounted in generally the same environment and therefore have the same characteristics. The emitter of transistor 37 is connected to operating voltage V1 through resistor 39. Resistor 31 has twice the resistance of resistor 39 (typically resistor 31 is 2,000 ohms and resistor 39 is 1,000 ohms) to provide approximately twice the current out of the collector of transistor 37 than out of the collector of transistor 33, as is discussed further below.

Line 43 carries the current out of the collector of transistor 33. Bipolar transistor 41 has its emitter connected to line 35 and its base connected to line 43. As the base-to-emitter path of transistor 41 has the base-to-collector of transistor 33 in parallel with it, current excursions from line 35 through transistor 41 are limited. Transistor 41 does provide a path to ground through resistor 45, connected from the collector of transistor 41 to ground, sufficient for current flow during normal operation. Line 43 also connects to the collector of bipolar transistor 49.

The junction of the collector of transistor 37 and diode 23 is connected by line 29 to point 21. The opposite side of diode 23 is connected to line 47. Line 47 connects to the collector of transistor 51. Transistors 49 and 51 are selected to be virtually identical. They are mounted in generally the same environment and therefore have the same characteristics. The emitter of transistor 49 is connected through resistor 53 to V3, a source of operating voltage of opposite sense to voltage V1 (typically −5 volts). the emitter of transistor 51 is connected to V3 through resistor 55. Resistors 53 and 55 are the same resistance (typically about 9000 ohms). The bases of transistors 49 and 51 are connected together on line 57 to ground.

The constant current obtained results from the two base-emitter junctions of transistors of like charatreristics carrying the same or directly proportional currents. Thus, transistors 33 and 37 have bases at the same potential which are connected to V1 through resistances which are in a ratio of 1 to 2. Accordingly, where current can flow normally through transistors 33 and 37, the current from the collector of transistor 33 will be approximately one-half of that from the collector of transistor 37. (This ratio is approximate, rather than substantially exact, because the different currents will result in somewhat different operating characteristics.)

A division of current between that through diode 23 and line 29 is achieved by transistors 49 and 51, which have like characteristics, base-emitter junctions at the same potential, and emitters connected through identical resistors 53 and 55 to V3. Transistor 49 necessarily carries all the current from transistor 33 as line 43 is the only path for that current. Transistor 51 finds equilibrium only when it carries the same current, since a higher current would produce a drop across resistor 55 tending to lower the base-emitter voltage.

Accordingly, in normal operation one-half of the current from transistor 37 flows through transistor 51. The other half necessarily flows through line 29 and the voltage on line 29 from V1 inherently is dropped by resistor 39 and transistor 37 only to the level necessary to assure such current flow on line 29. As diode 23 is past line 29, diode 23 carries the same current as line 29. (Typical current values is one-half milliampere through lines 29 and 47, and one milliampere through transistor 37.)

During printing, one or more of the switches 17*a* through 17*n* is closed. Selected ones of electrodes 1*a* through 1*n* are connected to a diode 19*a* through 19*n*, respectively, when the intervening switch 17*a* through 17*n* is closed. That diode 19*a* through 19*n* connected to the electrode 1*a* through 1*n* of lowest potential is biased into conduction by the potential from line 29. All of the current on line 29 is carried by that one of diodes 19*a* through 19*n*. (Instances where two or more switched-in ones of electrodes 1*a* through 1*n* are of such similar low potential that more than one of diodes 19*a* through 19*n* conduct may occur, but the frequency and duration are so limited as to be acceptable in normal printing. As will be clear below, the voltage seen at control input 5 will be slightly, but not drastically affected.)

In the usual case, therefore, during printing the same current flows through only one of diodes 19*a* through 19*n* and through diode 23, and that current flows in the same sense or polarity with respect to those diodes. As those diodes have the same characterstics, the potential drop from the electrode 1*a* through 1*n* connected to the conducting diode 19*a* through 19*n* is higher at point 21, which is across the one of diodes 19*a* through 19*n* conducting, but lowered the same amount across diode 23, since their polarity in the path to input 5 is opposed. Accordingly, the lowest potential of electrodes 19*a* through 19*n* in operation is applied to input 5. (In the occasional instances when more than one of diodes 19*a* through 19*n* conduct simultaneously, the potential to input 5 can vary from that of the lowest of electrodes 1*a* through 1*n* only by the forward bias drop across diode 23. Also, it will be apparent that approximate accuracy normally will be obtained even when the current varies greatly from the ideal because voltage drops across typical diodes vary only modestly with different currents within the order of magnitude involved.)

In operation, reference current source 25 is set at a level defining a level of current to electrode 1*a* through 1*n* defining a desired extent of printing. (In resistive ribbon printing, increased current normally increases heat created in the ribbon and darkens printing.) By ordinary circuit laws, with a fixed current, Iref, from source 25, the potential at reference input 7, V7, is the potential on line 13, V2, less Iref multiplied by the resistance of resistor 27, R27, i.e. V7−V2−Iref·R27 (Formula A).

V7 is on the minus input of amplifier 4. Where it is lower than the potential at the control input 5, V5, the voltage at output 9 increases immediately by action of amplifier 4. Where V7 is higher than V5, the signal on output 9 immediately falls.

Equilibrium is reached early in each print operation after selection of electrodes 1*a* through 1*n* by selected ones of switches 17*a* through 17*n*. At equilibrium, the potentials V5 and V7 are equal since the system of amplifier 4 combined with the feedback signal through resistor 27 is a differential amplifier. The current through the selected one of electrodes 1*a* through 1*n* of lowest potential produces a voltage drop from V2, across the one of resistors 15*a* through 15*n* connected to the one of electrodes 1*a* through 1*n* having the lowest potential. The voltage across the conductive one of diodes 19*a* through 19*n* is counteracted by that of diode 23. Accordingly, V5=V2−Iel·R15 (Formula B).

At equilibrium, Formulas A and B can be equated. Thus, V2−Iref·R27=V2−Iel·R15

Solving: Iel=Iref·R27/R15.

This establishes that current source 25, producing a selected Iref, directly controls the current to the lowest-voltage selected electrode of electrodes 1*a* through 1*n*. Moreover, this current magnitude is independent of the voltage level at the electrodes 1*a* through 1*n* or in ribbon 2.

Those selected ones of electrodes 1*a* through 1*n* having higher potential are driven by the same potential, V2, acting through an identical one of resistors 15*a* through 15*n*. The current to such higher-voltage electrodes is limited in proportion to the higher voltage, thereby preventing power excursions which typically damage the ribbon or other material which receives current from the electrodes 1*a* through 1*n*. Such higher voltage may be a result of poor contact between an electrode 1*a* through 1*n* with a surface to which it connects.

The level of V2 and resistors 15*a* through 15*n*, which are of identical resistivity, are selected to be within desired operating characteristics of the ribbon 2 or other medium driven by electrodes 1*a* through 1*n*. The magnitude of V2 and resistors 15*a* through 15*n* is selected more specifically to achieve approximately constant power delivered into the ribbon 2. Delivery of constant power produces more uniform printing operation and limits current flow. Current fluctuations are reduced, which reduces arcing tendencies.

Constant power is approximated by selecting each resistor 15*a* through 15*n* equal to the nominal effective resistance into each of the electrodes 1*a* through 1*n*. (The nominal effective resistance is, of course, identical for all the electrodes 1*a* through 1*n*.)

Figure 2:
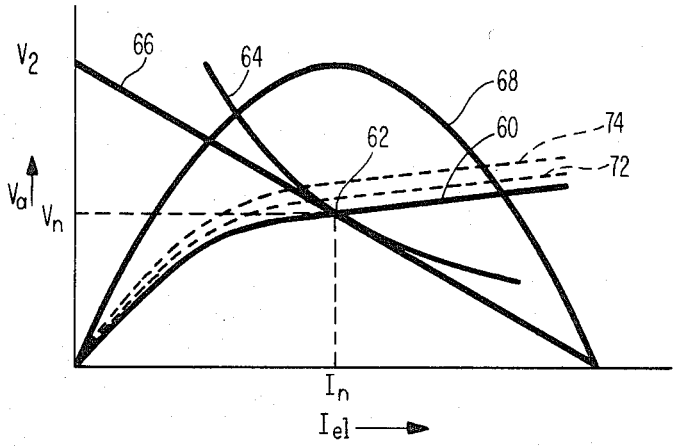

FIG. 2 is a plot of the typical characteristic curve 60 of a ribbon 2 for voltage directly across the ribbon, Va, and current through one electride, Iel. Normally, for predictable operation, the fast rising knee at the left of the characteristic curve is avoided and a nominal operation point is selected past the knee, such as a point 62. This nominal operating point has a voltage into the ribbon of Vn and a current In, resulting in power of Vn·In.

The voltage directly across the ribbon, Va, is often termed the through voltage, A second voltage drop, much smaller than Va, is that along the length of ribbon 2 to ground. This is often termed the common voltage, Vc. Typically, the ribbon has an internal metal or other highly conductive layer 2b, thereby facilitating conduction along the ribbon to ground roller 3 and keeping Vc low. Va produces the heating effect for printing and is therefore the voltage which interacts with Iel to determine the degree of printing. Vc varies significantly with the number of electrodes 1a through 1n driven.

Diodes 19a through 19n sense the combined voltage of Va and Vc. Since the regulated system is designed to provide a constant current to the electrode 1a through 1n having the lowest voltage, changes in Vc are neutralized. A change in Vc appears in the same sense at the diodes 19a through 19n, and the output of amplifier 4 responds to the changed input on control input 5 to change the output voltage on line 13 to maintain the constant current, thereby counteracting the change in Vc.

Curve 64 is a plot of Va·Iel=Vn·In, which plots exactly constant power. Exactly constant power cannot be achieved by selection of magnitude of resistors 15a through 15n because circuit operation is essentially linear, with the voltage on line 13 operating on series circuits, each containing a resistor 15a through 15n.

Assuming voltage on line 13, V2, constant, any operating point must be found on a straight line 66 having a slope defined by the resistivity of one resistor 15a through 15n, which resistivity may be denominated R15. By inspection, such a straight line will closely follow the curved line when it is tangent to it. The tangent is found as follows. At point 62 nominal operation is described as follows:

$$V2 = In \cdot R15 + Vn$$

(Formula C)

$$Vn \cdot In = \text{Constant } (k)$$

(Formula D)

Solving:

$$In = \frac{k}{Vn}$$

(Rearringing D)

$$Vn = V2 - \frac{kR15}{Vn}$$

(Rearringing C and substituting) from D)

$$Vn^2 = V2Vn - kR15$$

(Multiplying by $Vn$)

$$Vn = \frac{V2}{2} \pm \tfrac{1}{2}\sqrt{V2^2 - 4kR15}$$

(Solving by quadratic equation)

For the line to have one point of intersection:

$$\sqrt{V2^2 - 4kR15} = 0$$

Therefore, for one point of intersection:

$$V2 = 2Vn \text{ and } R15 = \frac{V2^2}{4k}$$

For Vn to equal one-half of V2, the drop across R15 at nominal current must equal Vn, or In·R15=Vn. This mathematically justifies the foregoing design selection of each resistor 15a through 15n being selected to provide a voltage drop the same as the nominal voltage drop across the ribbon 2.

Selection of a line 66 which is tangent to line 64 as an approximation of constant power is confirmed by a calculation which shows that the operating point at Va=½V2 is the peak of the power response.

The overall operating characteristics into ribbon 2 are defined by straightforward application of Ohm's law, resulting in the equation:

$$Iel = \frac{V2 - Va}{R15},$$

which is the equation for a straight line (corresponding to load lines often considered in solving circuit operation). Power at each operating point is Va·Iel. Mulitplying Va·Iel and substituting the foregoing expression for Iel:

$$\text{Power} = \frac{Va \cdot V2}{R15} - \frac{Va^2}{R15}$$

Differentiating with respect to Va:

$$\frac{V2}{R15} - \frac{2Va}{R15}$$

Solving for zero (which, of course, indicates a peak response):

$$Va = \frac{V2}{2}$$

The full range of power distribution, which is parabolic with the peak at the point where Va is one-half of V2, is shown on FIG. 1 as line 68.

It will be recognized that this approximation of constant power is valid so long as the voltage V2 applied is constant or varies moderately with voltage at the ribbon 2 or other driven element. In this embodiment, the voltage V2 is that on line 13 of FIG. 1, and varies with the lowest electrode voltage. To the extent it varies from the nominal conditions for which the system was designed, the approximation may be less exact than that when the voltage V2 is constant. Since the advantages of approximating constant power do not depend on high precision, they are realized meaningfully so long as some significant approximation is realized.

In the FIG. 1 embodiment, all electrodes 1a through 1n but having the lowest voltage will necesssarily be operating into ribbon 2 characteristics having a higher voltage drop. Dotted curves 72 and 74 are illustrative of characteristics into which the other electrodes may be operating. If each were selected as the nominal characteristic for purposes of design, the associated constant power curve corresponding to curve 64 would be slightly different from curve 64. For purposes of specific design with respect to the embodiment of FIG. 1, a curve representative of mean operation is selected for design purposes, which might for example, be curve 74 is curve 72 and curve 60 are unrepresentatively low.

Modification within the concepts and spirit of the invention necessarily are available.

What is claimed is:

1. Circuitry to provide drive current to a plurality of electrodes suitable for printing comprising:

a separate electrical connection to a first point from each of said electrodes, each said connection being such that the voltage at said first point varies essentially as a function of the potential of said electrodes, each said connection being an electrical path in parallel with drive current through said electrodes, a differential voltage amplifier having a control input which varies essentially as a function of the potential of said first point and an output, and means connecting said output of said amplifier to said electrodes to provide drive current to said electrodes in proportion to the output voltage of said amplifier.

2. The circuitry as in claim 1 in which each said separate electric connection includes in series a unidirectional devices of polarity to block signals from said amplifier driving said electrodes, so that the potential of said first point can rise only to a level corresponding to the level of the lowest potential of all of said electrodes.

3. The circuitry as in claim 2 in which said first point is connected through a voltage-dropping element to a source of operating potential.

4. The circuitry as in claim 3 also comprising a unidirectional device connected in series between said first point and said control input in polarity opposite said unidirectional devices in said separate electrical connections, all of said unidirectional devices having the generally same operating characteristics, and means to generate a first generally constant current to said first point and a second generally constant current from said first point through said unidirectional device in opposite polarity, said second current being substantially one-half the amount of said first current.

5. The circuitry as in claim 1 in which said amplifier has said control input and a reference input and produces at said output a signal proportional to the difference of said control input and said reference input and has a feedback circuit including a connection from said output to said reference input to move the input on said reference input to equal the input on said control input.

6. The circuitry as in claim 2 in which said amplifier has said control input and a reference input and produces at said output a signal proportional to the difference of said control input and said reference input and has a feedback circuit including a connection from said output to said reference input to move the input on said reference input to equal the input on aid control input.

7. The circuitry as in claim 3 in which said amplifier has said control input and a reference input and produces at said output a signal proportional to the difference of said control input and said reference input and has a feedback circuit including a connection from said output to said reference input to move the input on said reference input to equal the input on said control input.

8. The circuitry as in claim 4 in which said amplifier has said control input and a reference input and produces at said output a signal proportional to the difference of said control input and said reference input and has a feedback circuit including a connection from said output to said reference input to move the input on said reference input to equal the input on said control input.

9. The circuitry as in claim 5 also comprising a resistance in series between said output and said reference input, and a source of adjustable current connected to said reference input.

10. The circuitry as in claim 6 also comprising a resistance in series between said output and said reference input, and a source of adjustable current connected to said reference input.

11. The circuitry as in claim 7 also comprising a resistance in series between said output and said reference input, and a source of adjustable current connected to said reference input.

12. The circuitry as in claim 8 also comprising a resistance in series between said output and said reference input, and a source of adjustable current connected to said reference input.

13. Circuitry to drive current through a plurality of electrodes suitable for printing comprising:

an amplifier system having a control input and a reference input and an output connected in a feedback mode to produce an output signal which changes in a direction to bring the signal on said control input and the signal on said reference input to a fixed relationship, means connecting said output to said electrodes to provide drive current to said electrodes, a plurality of diodes, means connecting separate ones of said diodes between said control input and each of said electrodes, all said diodes being connected in a polarity to block current from said output providing said drive current, and means connecting a reference current to said reference input.

14. The circuitry as in claim 13 in which a point connected to the junction of said control input and said diodes is connected through a voltage-dropping element to a source of operating potential.

15. The circuitry as in claim 14 also comprising a diode connected in series between said junction and said control input in polarity opposite to said plurality of diodes, all of said diodes having the same general operating characteristics, and means to generate a first generally constant current to said junction and a second, generally constant current from said junction through said diode in opposite polarity, said second current being substantially one-half the amount of said first current.

16. The circuitry as in claim 13 also comprising a resistance in series between said output and said reference input, and in which said source of reference current is a source of adjustable current.

17. The circuitry as in claim 14 also comprising a resistance in series between said output and said reference input, and in which said source of reference current is a source of adjustable current.

18. The circuitry as in claim 15 also comprising a resistance in series between said output and said reference input, and in which said source of reference current is a source of adjustable current.

19. Circuitry to drive current through a plurality of electrodes suitable for printing comprising:

means to provide a signal to a first point which varies with the lowest potential of each of said electrodes, differential amplifier means having a control input and an output for producing on said output a signal a predetermined potential higher than the signal on said control input, means connecting said first point to said control input so that the signal on said control input varies directly with the lowest potential of each of said electrodes, and means connecting said output of said amplifier through separate, substantially identical resistive means to each of said electrodes to drive said electrodes for printing.

20. The circuitry as in claim 19 in which said amplifier is a differential amplifier having said control input and a reference input and producing at said output a signal proportional to the difference of said control input and said reference input and having a feedback circuit connected from said output to said reference input to move the input on said reference input to equal the input on said control input.

21. The circuitry as in claim 20 also comprising a resistance in series between said output and said reference input, a source of adjustable current connected to said reference input.

22. The circuitry as in claim 19 also comprising a ribbon to be driven with printing current by said electrodes, said ribbon producing generally satisfactory printing when printed from by application of voltage in the general region of a nominal operating voltage applied across said ribbon by each said electrode, said amplifier output being approximately twice said nominal operating voltage and each said resistive means being of resistance to reduce said output by approximately one-half when said ribbon operates at said nominal operating voltage.

23. The circuitry as in claim 20 also comprising a ribbon to be driven with printing current by said electrodes, said ribbon producing generally satisfactory printing when printed from by application of voltage in the general region of a nominal operating voltage applied across said ribbon by each said electrode, said amplifier output being approximately twice said nominal operating voltage and each said resistive means being of resistance to reduce said output by approxmately one-half when said ribbon operates at said nominal operating voltage.

24. The circuitry as in claim 21 also comprising a ribbon to be driven with printing current by said electrodes, said ribbon producing generally satisfactory printing when printed from by application of voltage in the general region of a nominal operating voltage applied across said ribbon by each said electrode, said amplifier output being approximately twice said nominal operating voltage and each said resistive means being of resistance to reduce said output by approximately one-half when said ribbon operates at said nominal operating voltage.

25. A circuit to drive current for printing with approximately constant power comprising:

a plurality of electrodes;

a printing ribbon which produces generally satisfactory printing when printed from by application of voltage in the general region of a nominal operating voltage separated from a operating region having a fast rising characteristic applied across said ribbon by one of said electrode contacting said ribbon, a power source to apply power to said electrodes, and a plurality of resistors, each in series between said voltage source and said one of said electrodes, the magnitude of voltage from said power source being approximately twice that of said nominal voltage and the magnitude of said resistors being that which reduces the voltage of said power source by approximately one-half when said ribbon is operate at said nominal operating voltage.

26. The circuit as in claim 25 in which said power source is controlled by a differential amplifier having a control input and also comprising means to measure a voltage at said ribbon and mean to apply said measured voltage to said control input.

27. A printing system comprising:

a printing ribbon which produces generally satisfactory printing when voltage is applied to it in the general region of a nominal operating voltage separated from a operating region having a fast rising characteristic, a plurality of electrodes to apply said voltage, a electrical power source to apply a drive voltage to said electrodes across said ribbon, the magnitude of the voltage of said power source being approximately twice that of said nominal voltage, and a plurality of resistive means, each connected between said power source and one of said electrodes, each of a resistance to produce a drop approximately equal to said nominal operating voltage when said ribbon is operated at said nominal operating voltage.

28. The printing system as in claim 27 in which said power source is controlled by a differential amplifier having a control input and also comprising means to measure a voltage at said ribbon and means to apply said measured voltage to said control input.

* * * * *